United States Patent [19]

Otake

[11] Patent Number: 4,937,960

[45] Date of Patent: Jul. 3, 1990

[54] PICTURE DISPLAY AND APPARATUS FOR MAKING THE SAME

[75] Inventor: Katsumi Otake, Tokyo, Japan

[73] Assignee: Fuji Photo Film Co., Ltd., Kanagawa, Japan

[21] Appl. No.: 130,263

[22] Filed: Dec. 8, 1987

[30] Foreign Application Priority Data

| | | | |
|---|---|---|---|
| Dec. 8, 1986 | [JP] | Japan | 61-188638[U] |
| May 22, 1987 | [JP] | Japan | 62-77051 |
| May 27, 1987 | [JP] | Japan | 62-130853 |

[51] Int. Cl.[5] ..... G09F 19/14

[52] U.S. Cl. ..... 40/453; 40/470; 40/160

[58] Field of Search ..... 40/160, 453, 605, 470, 40/453

[56] References Cited

U.S. PATENT DOCUMENTS

| | | | |
|---|---|---|---|
| D. 270,319 | 8/1983 | Grennberg | 40/453 |
| 386,780 | 7/1886 | Heinemann | 40/453 |
| 2,850,825 | 9/1958 | Grants | 40/453 |
| 3,041,761 | 7/1962 | Knox | 40/160 |
| 3,135,063 | 6/1954 | Ricks | 40/453 |
| 3,503,147 | 3/1970 | Herrin et al. | 40/160 |

FOREIGN PATENT DOCUMENTS

| | | | |
|---|---|---|---|
| 327924 | 4/1903 | France | 40/453 |
| 687209 | 4/1930 | France | 40/453 |

*Primary Examiner*—John Weiss

*Attorney, Agent, or Firm*—Sughrue, Mion, Zinn, Macpeak & Seas

[57] ABSTRACT

A picture display assembly for displaying two different pictures includes a wavelike picture display member having two interleaved series of display sections disposed in different respective directions. Whole pictures are divided into picture segments which are attached or glued to the display sections for each picture to be displayed. The wavelike picture display member with two sets of picture segments attached is made by alternately feeding and gluing picture segments of the two different whole pictures one after another onto a web-like mounting sheet, forming folding lines between the picture segments. Thereafter the mounting sheet with picture segments glued is cut to a length sufficient to include the two sets of the two different whole pictures. Finally, the mounting sheet with the picture segments attached is folded in zigzags to form the two interleaved series of picture segments.

10 Claims, 8 Drawing Sheets

PICTURE DISPLAY AND APPARATUS FOR MAKING THE SAME

BACKGROUND OF THE INVENTION

The present invention relates to a picture display for displaying different pictures, and to an apparatus for making such a picture display.

There exist various picture display devices which can display two different pictures. Such a picture display device comprises a wavelike display sheet which is folded to form two interleaved series of display sections facing in different directions. Two different pictures, each divided into a plurality of picture segments, may be shown by attaching the picture segments to the respective series of display sections of the display surface. By viewing the display surfaces from different angles, each picture can be seen independently from the other.

One disadvantage associated with using a wavelike display sheet in this manner is that the wavelike display sheet is difficult and expensive to make. Also, it is difficult to attach picture segments onto the display sections of such a wavelike display sheet.

SUMMARY OF THE INVENTION

In view of the foregoing and other deficiencies, it is one object of the present invention to provide an improved picture display assembly which can be made quite easily.

It is another object of the present invention to provide an apparatus for manufacturing inexpensively the picture display sheet used in the picture display assembly.

In order to accomplish the foregoing objects, the picture display assembly of the present invention comprises a wavelike picture display surface forming member, having two interleaved series of display sections, and a display stand for supporting the wavelike picture display surface forming member. The wavelike picture display surface forming member is formed in zigzags to direct the two interleaved series of display sections in different respective directions. Two sets of picture segments are attached respectively to the a respective one of the series of display sections. Each set of picture segments is made by dividing a complete original picture into a plurality of smaller segments and attaching the segments to one of the interleaved series of display sections of the wavelike picture display surface forming member.

According to a preferred embodiment of the present invention, the wavelike picture display surface forming member comprises a picture display sheet which is made by folding a generally rectangular picture display sheet member, such as a paper sheet or a thin plastic sheet, on which the picture segments of the two different original pictures then are attached in interleaved fashion to form two interleaved series of picture segments.

This picture display sheet member may be made in commercial quantities by using an apparatus according to the present invention. The apparatus comprises transfer means for transferring a long mounting sheet, one surface of which has a gluing material layer applied thereto; a feeding and attaching member for attaching the picture segments of at least two different pictures in interleaved fashion, one after another, onto the mounting sheet: folding line forming means for forming lines between the picture segments; and a cutter for cutting the mounting sheet along the folding lines to a length sufficient to include two different pictures.

BRIEF DESCRIPTION OF THE DRAWINGS

The foregoing and other objects of the present invention will become apparent from the following description of the preferred embodiments, with reference to the accompanying drawings, in which like parts are designated by like reference numerals and symbols throughout the views thereof, and wherein.

DETAILED DESCRIPTION OF THE PREFERRED EMBODIMENTS

Figure 1:
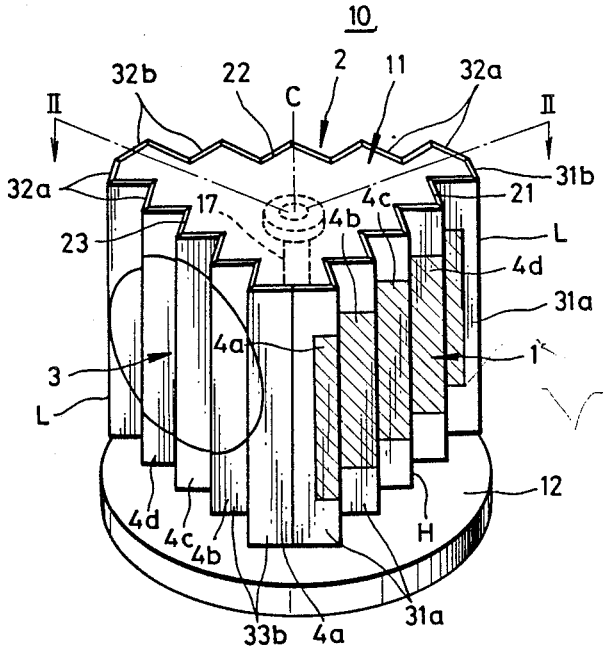
FIG. 1 is a perspective view of a stand type picture display assembly of a first preferred embodiment of the present invention.
Figure 2:
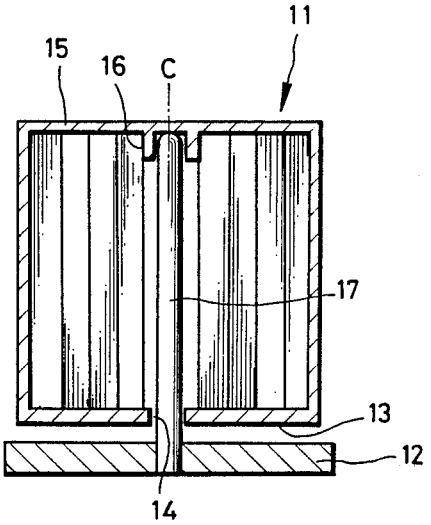
FIG. 2 is a cross sectional view of the picture display assembly of FIG. 1 taken along a line II—II in FIG. 1.

Referring now to FIGS. 1 and 2 showing a picture display in accordance with a first preferred embodiment of the present invention, a display assembly 10 comprises a generally triangular prism shaped display body 11 and a display stand 12 for supporting the display body 11. The triangular prism shaped display body 11 takes the form of a closed hollow triangular barrel formed with a circular hole 14 in its bottom wall 13 and an annular bearing rib 16 on the inner surface of its top wall 15. The display stand 12 is provided at its center with a fixed vertical column 17 having a rounded top end. The rounded top end of the fixed vertical column 17 is received in the annular bearing rib 16 to support the display body 11 rotatably about the center line C of the fixed vertical column 17.

The triangular prism shaped display body 11 comprises three side walls 1 to 3 each having wavelike display surfaces 21 to 23 of which wave ridge lines L are parallel to the center line C of the fixed vertical column 17. Onto each wavelike display surface 21, 22, 23, are attached two different pictures. Taking the wavelike display surface 21 for example, there are formed two interleaved series of display sections 31*a* and 31*b* facing the different directions.

Figure 3:
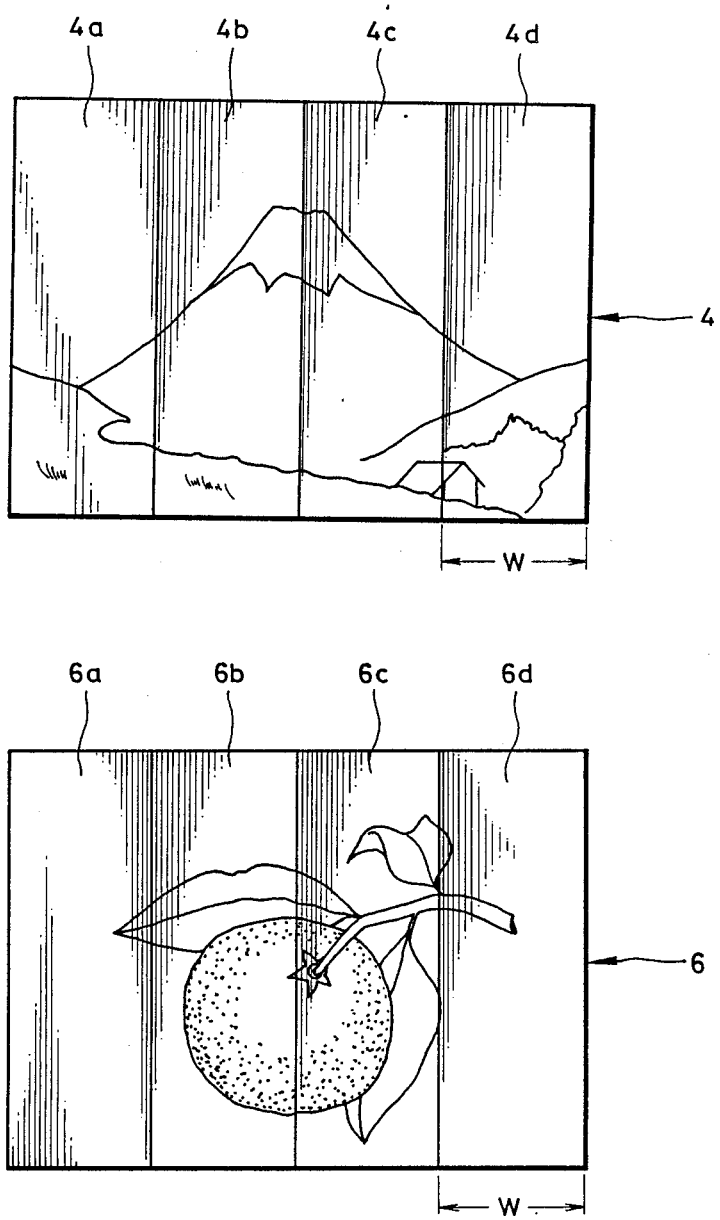
FIG. 3 is a plane view of complete original pictures.

On one of the interleaved series 31*a* of display sections there are glued a plurality of picture segments, for example, 4*a* to 4*d*, which together comprise a complete original picture 4 (see FIG. 3). On the other hand, on the other of the interleaved series 31*b* of display sections there are glued a plurality of picture segments 6*a* to 6*d* which together comprise another complete original picture 6 (see FIG. 3).

This side wall 1 of the triangular prism shaped display body 11 is made of paper or thin plastic sheet folded in zigzag. The side walls 2 and 3 have two interleaved series of display sections 32*a* and 32*b*, and 33*a* and 33*b*, respectively, which have the same construction and function as the interleaved series of display sections 31*a* and 31*b* of the side wall 1. Thus, no further description of the elements 32*a*, 32*b*, 33*a*, and 33*b* is necessary.

When viewing the display assembly 10 from the front with respect to the drawing, the picture segments 4*a* to 4*d* glued to the first interleaved series 31*a* of display sections can be viewed in succession as a single picture substantially similar to the complete original picture 4 on the right hand side of the viewer, but the picture segments 6*a* to 6*d* glued to the other interleaved series 31*b* of display sections are out of sight. By turning the triangular prism shaped display body 11 of the display assembly 10 clockwise through about 120 degrees the picture segments 6*a* to 6*d* can be viewed in succession as a single picture substantially similar to the complete original picture 6 on the left hand side of the viewer. At this time, on the right hand side of the viewer, picture segments 4*a* to 4*d* glued to the interleaved series 32*a* of display sections of the wavelike display surface 22 of the side wall 2 also can be viewed in succession as a single picture.

In the above described embodiment, the same picture segments 4*a* to 4*d*, 6*a* to 6*d* of the complete original pictures 4 and 6 shown in FIG. 3 are applied to each of the wavelike display surfaces 22 and 23. However, as many as six different pictures may be applied on the three wavelike display surfaces 21 to 23. Thus, six different pictures may be viewed selectively, according to viewing position. The display sections are folded at an angle between 80° and 90° in order to prevent any of the picture segments from being partially out of sight. The triangular prism shaped display body 11 may be rotated by a motor in any well known manner.

Figure 4:
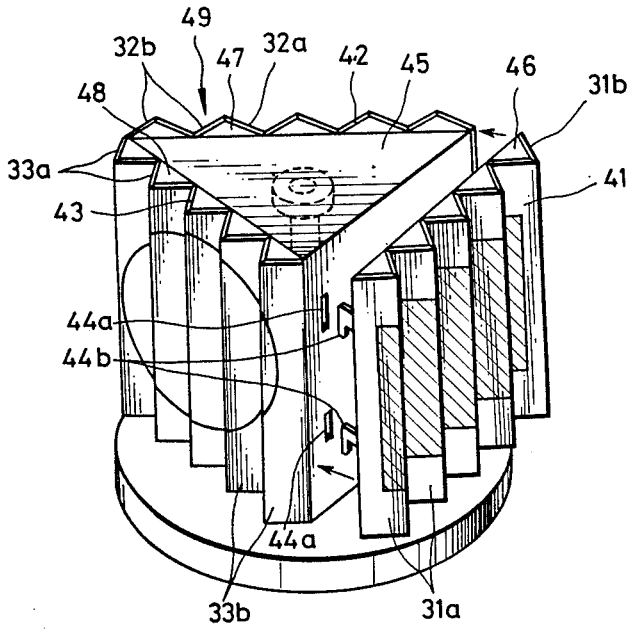
FIG. 4 is a perspective, partly exploded, view of the stand type picture display assembly of a second preferred embodiment of the present invention.

FIG. 4 shows a variation of the triangular prism shaped display body 11 of FIG. 1. In this embodiment, a display body 49 comprises a triangular prism shaped body 45, with four slits 44*a* formed in each side wall, which is supported by the stand 12 for rotation. To each side wall of the triangular prism shaped body 45 there is attached respectively a picture display member 46, 47, 48 having a respective wavelike display surface 41, 42, 43 which forms two interleaved series of display sections 31*a* and 31*b*, 32*a* and 32*b*, and 33*a* and 33*b*. Each picture display member 46, 47, 48 is provided with four hook members 44*b*, projecting from opposite edges thereof, which are engageable with the slits 44*a* formed in each side wall of the triangular prism shaped body 45.

Each picture display member 46, 47, 48 is detachably mounted on each side wall by engaging the hooks 44*b* with the slits 44*a*. In the same manner as in the previous embodiment, two interleaved series of picture segments 4*a* to 4*d* and 6*a* to 6*d* of different original pictures 4 and 6 are applied to each wavelike display surface of the picture display member 46, 47, 48. In this embodiment, with the provision of the slits 44*a* and the hooks 44*b*, each picture display member 46, 47, 48 easily may be replaced with a different desired one having two interleaved series of picture segments of different original pictures glued thereto.

Figure 5:
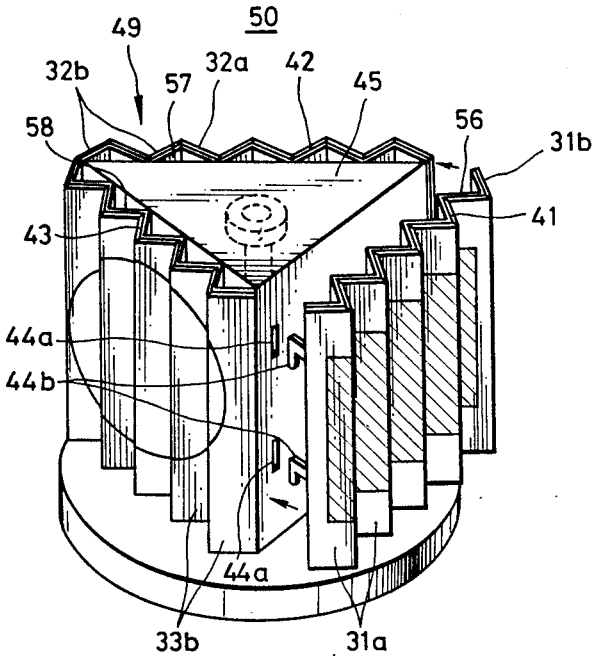
FIG. 5 is a perspective, partly exploded, view of the stand type picture display assembly of a third preferred embodiment of the present invention.
Figure 6:
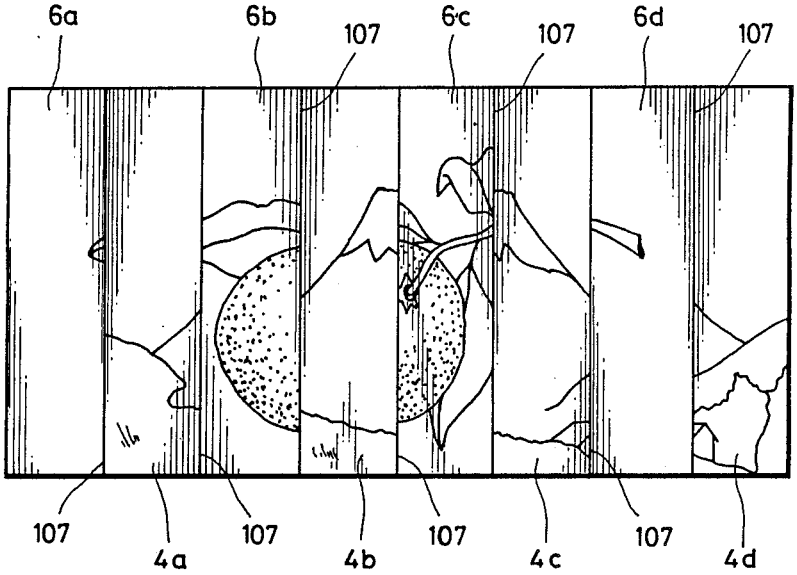
FIG. 6 is a plane view of a picture display sheet made by an apparatus according to the present invention and used in the picture display assembly shown in FIG. 5.

FIG. 5 shows a picture display assembly of another preferred embodiment of the present invention in which the picture display members 46, 47, 48 of FIG. 4 are replaced with picture display sheets 56, 57, 58 which are made by folding in zigzag fashion a rectangular picture display sheet 8 shown in FIG. 6 to form two interleaved series of display sections 31*a* and 31*b*, 32*a* and 32*b*, 33*a* and 33*b* thereon. This rectangular picture sheet 8 includes two interleaved series of picture segments. More specifically, a first series of picture segments 4*a* to 4*d* forms a complete picture substantially the same as the original picture 4 shown in FIG. 3, and a second series of picture segments 6*a* to 6*d*, interleaved with the first series, forms another complete picture substantially the same as the original picture 6 shown in FIG. 3. This picture display sheet 8 is made by an apparatus which will be described in detail later in connection with FIG. 13.

Figure 7:
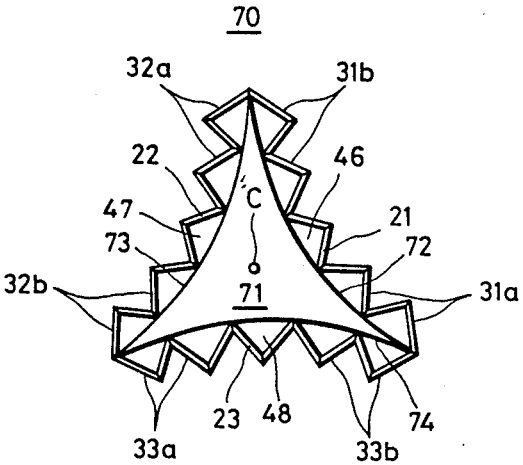
FIG. 7 is a top plane view of the stand type picture display assembly of a fourth preferred embodiment of the present invention.

FIG. 7 shows another embodiment of the present invention in which a picture display assembly 70 includes a rectangular prism-like display body 71 having concave side walls 72 to 74 to which picture display members similar to the picture display members 46 to 48 of FIG. 4, or the picture display sheets 56 to 58 of FIG. 5 are attached. The structure of this concave walled picture display assembly 70 is advantageous in that it prevents any part of a picture segment glued to the display section from being out of sight.

Figure 8A:
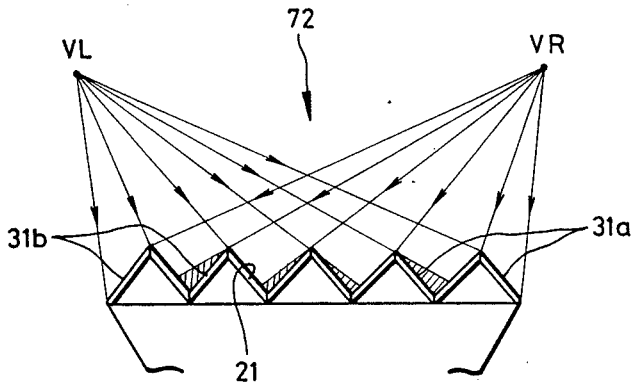
FIGS. 8A and 8B are explanatory illustrations showing a viewing feature of the picture display assembly of FIG. 7.
Figure 8B:
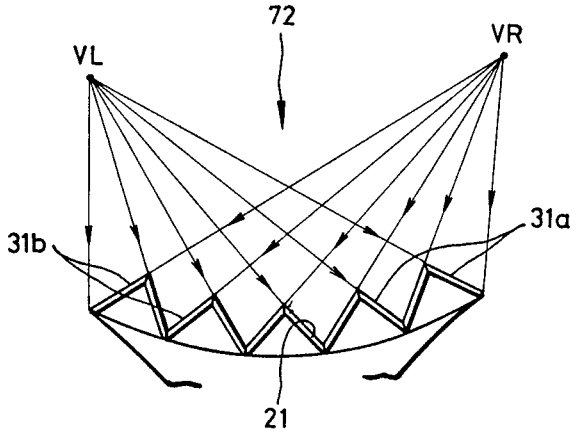

Looking at this aspect of the embodiment of FIG. 7 in greater detail with reference to FIGS. 8A and 8B, if the picture segments are applied onto the wavelike display surface formed on a flat side wall as is shown in FIG. 8A, shadowed portions of the display sections 31*a* or 31*b* are replaced out of sight when viewed from a viewing position VR or VL, resulting in a discontinuous or incomplete picture. On the other hand, if the picture segments are applied onto the wavelike display surface formed on a concave side wall as is shown in FIG. 8B, no portion of the display section 31 and 31*b* is out of sight when viewed from a position VR or VL. Therefore, the picture segments can be viewed in succession as a single picture at any position between the positions VR and VL.

Figure 9:
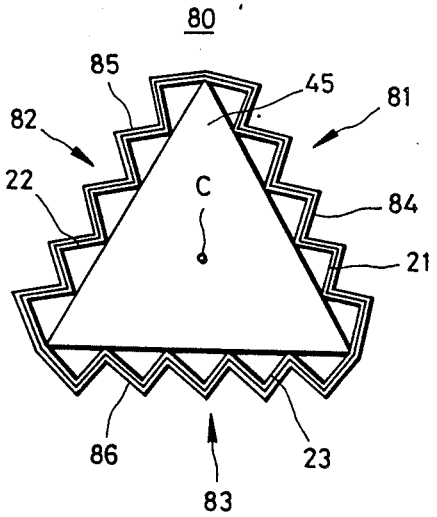
FIG. 9 is a top plane view of the stand type picture display assembly of a fifth preferred embodiment of the present invention.

FIG. 9 shows still another embodiment of the present invention in which a picture display assembly 80 has a rectangular prism shaped display body 45 of which each side wall 81, 82, 83 is formed with a respective wavelike display surface 21, 22, 23. Each wavelike display surface 21, 22, 23 is covered by a thin, transparent wavelike cover member 84, 85, 86 while maintaining a thin wavelike space therebetween. In this embodiment, the two interleaved series of picture segments are formed by inserting either the respective picture segments 4*a* to 4*d* and 6*a* to 6*d* (or the rectangular picture sheet 8 shown in FIG. 6 after being folded in zigzags) into the space formed between the corresponding display surface and cover member.

Figure 10:
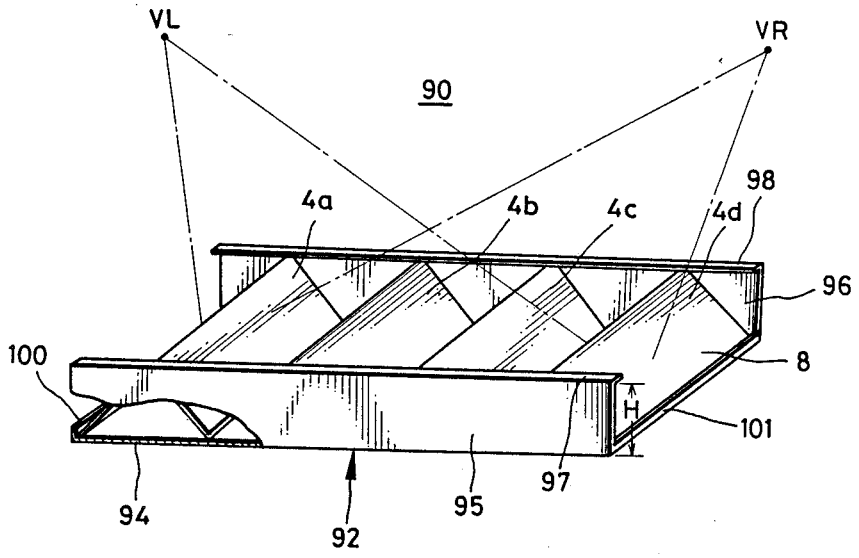
FIG. 10 is a perspective view of the panel type picture display assembly of a sixth embodiment of the present invention.

FIG. 10 shows a panel type picture display assembly 90 having a generally rectangular box-shaped display panel 92 holding therein a rectangular picture sheet 8 (as shown in FIG. 6) folded in zigzag. The display panel 92, which preferably is made of a plastic or aluminum sheet, has a base plate 94 formed at both ends thereof with upwardly bent flanges 100 and 101, and parallel side walls 95 and 96 formed with inwardly bent flanges 97 and 98. The picture display sheet 8, folded in zigzags, is received in the display panel 92 and retained therein by the flanges 97, 98, and 100, 101.

Figure 11:
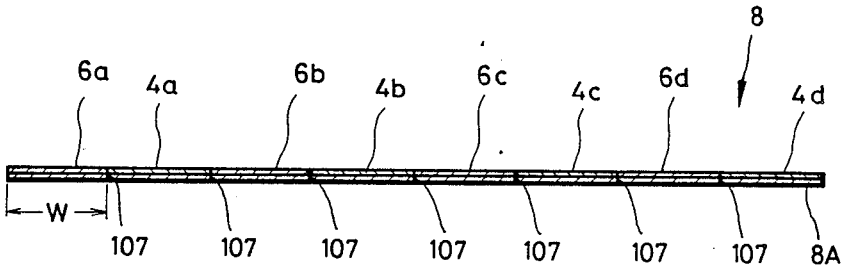
FIG. 11 is a side view of the picture display sheet of FIG. 6.
Figure 12:
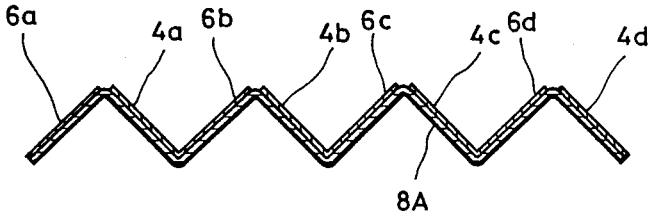
FIG. 12 is a side view of the picture display sheet of FIG. 6, but folded in zigzags.

As is shown in FIGS. 11 and 12, the wavelike picture display sheet 8 is made of a longitudinal mounting sheet 8A with a plurality of folding lines 107 which are formed at regular intervals spaced a distance W apart to define a plurality of display sections therebetween. On the mounting sheet 8A there are two interleaved series of picture segments 4*a* to 4*d* and 6*a* to 6*d* of the different pictures 4 and 6 shown in FIG. 3.

Each picture segment has a width W which is larger than the height H of the walls 95 and 96. In order to prevent each picture segment glued to the display section of the picture display sheet 8 from being out of sight when viewed sideways, it is desirable to fold the picture display sheet 8 in zigzag at angle between angle 80 and 90 degrees. If the picture display sheet 8 is to folded at a right angle, the width W of the picture segment should be $\sqrt{2}\times H$.

This picture display sheet 8 is folded in zigzag along the folding lines 107 to form the wavelike display member shown in FIG. 12. The wavelike display member then is inserted into the display panel 92, forward end first, until the forward end is stopped by the flange 100. When the picture display sheet 8 is forced into the display panel 92, the forwardmost display section with the picture segment 6*a* turns until the ridge line formed along the first folding line 107 is stopped by the flanges 97 and 98 of the side walls 95 and 96. Simultaneously, the bottom folding line 107 between the second and third display sections 4*a* and 6*b* is retained by the base plate 94 to form a first triangular prism shaped display section. In the same way, a plurality of triangle prism shaped display sections are formed in the display panel 92. Finally. the rear end of the picture display sheet 8 is snapped inside the flange 101 of the display panel 92. Since each triangular prism shaped display section is in the form of an isosceles triangle and is held firmly by the flanges 97, 98 and 100, 101, the picture display sheet 8 is not loose in the display panel 92.

This picture display assembly 90 is hung on a wall to display the pictures 4 and 6. If the picture display assembly 90 is viewed at an angle of, for example, about 45° from the right hand position VR, a first interleaved series of picture segments 4*a* to 4*d* can be seen in succession as a complete original picture 4. On the other hand, if viewed at an angle from the left hand position VL. the second of the interleaved series of picture segments 6*a* to 6*d* can be seen in succession as the complete original picture 6.

Figure 13:
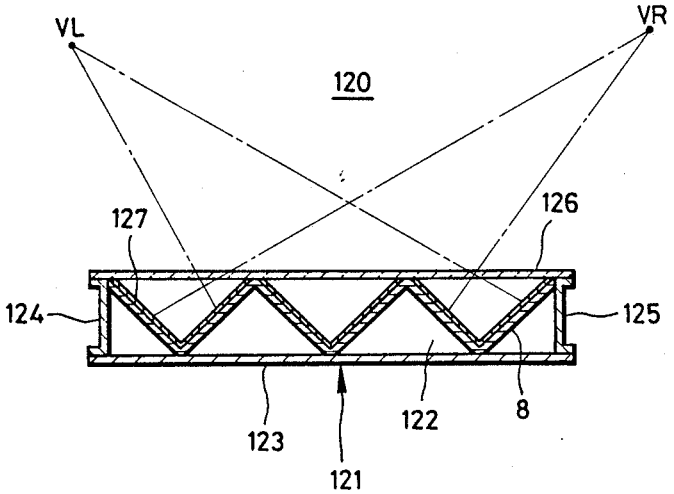
FIG. 13 is a cross sectional view of the panel type picture display assembly of a seventh preferred embodiment of the present invention.

Referring now to FIG. 13 showing a picture display assembly 120 of another preferred embodiment according to the present invention, a display panel 121 is shaped in a form similar to that of the display panel 91 of FIG. 10. The panel 121 additionally is provided with end covers 124 and 125 removably attached to both ends thereof in addition to side walls 122 formed by bending upwardly the side of the base plate 123. Over the top opening formed in the display panel 121 there is a transparent cover plate 126 fixed to the side walls 122. If the end covers 124, 125 are opaque, both of the end display sections of the picture display sheet 8 could be positioned out of sight. In order to avoid this situation, the picture display sheet 8 preferably is folded in such a way to orient each end display section 127 inwardly. With the provision of the transparent cover plate 126 no dust or foreign particles enter the display panel 121 to dirty the picture display sheet 8.

Figure 14:
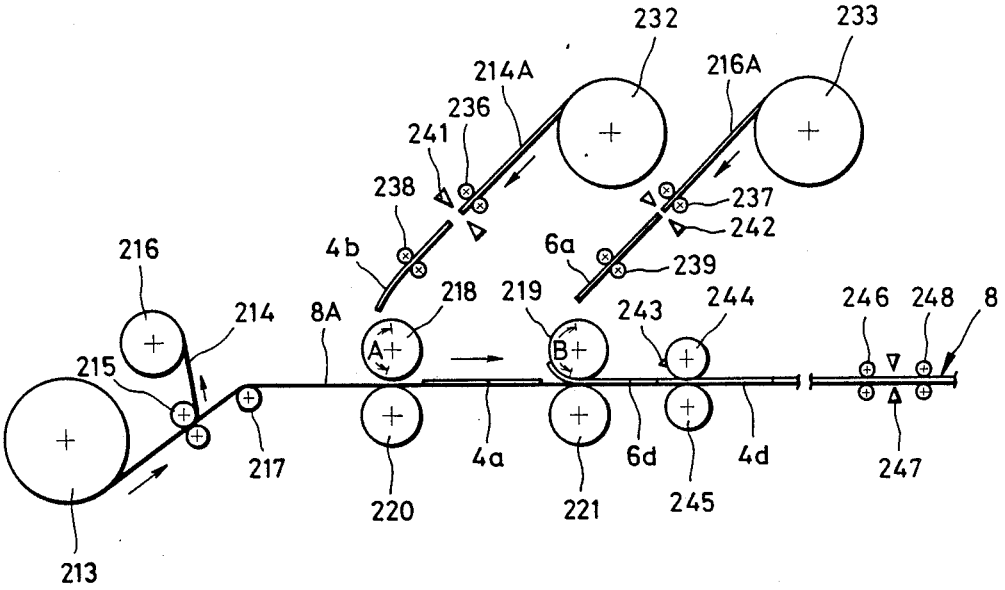
FIG. 14 is a fragmentary illustration showing the apparatus for making the picture display sheet of FIG. 6 of a preferred embodiment according to the present invention.

The picture display sheet 8 may be produced in commercial quantities by an automatic apparatus which constitutes part of the present invention. FIG. 14 shows the picture display sheet making apparatus, which has a reel 213 detachably mounted thereon. Rolled on the reel 213 is a web like mounting sheet 8A which is made of paper or thin plastic sheet and is applied with a layer of glue on its upper surface. A peelable cover sheet 214 covers the glue layer. The mounting sheet 8A is withdrawn from the reel 213 by a rotatable roller 215. A reel 216, synchronized with the roller 215, peels apart and takes up the cover sheet 214 from the mounting sheet 8A. After being withdrawn from the reel 213, the mounting sheet 8A passes a guide roller 217 toward a suction drum 218 rotating at the same circumferential speed as the forwarding speed of the mounting sheet 8A.

This suction drum 218 faces the glue layer of the mounting sheet 8A. and is formed with a suction area A where a picture segment can be sucked and released just before reaching an elastic roller 220. At a predetermined or preselected distance from the suction roller 218, a suction drum 219 and an elastic roller 221 are disposed opposite each other. The suction drum 219 also has a suction area B similar to the suction area A of the suction drum 218.

Above the suction drums 218 and 219, there are respective reels 232 and 233. Wound around the reel 232 is a web like picture sheet 214A on which a large number of identical or different original pictures 4 are printed consecutively. Wound around the reel 233 is a web like picture sheet 216A on which a large number of identical or different original pictures 6 are printed consecutively. Each picture sheet 214A, 216A is intermittently withdrawn from the respective reel 232, 233 by a respective nip roller 236, 237. When the nip roller 236, 236 contacts a respective sheet 214A, 216A, the respective picture sheets 214A and 216A are cut off by corresponding cutters 241 and 242 to provide smaller sections of picture segments 4*a* to 4*d* and 6*a* to 6*d* having a width W.

The picture segment 4*a* cut off by the cutters 241 is fed by feed rollers 238 to the suction drum 218. The feed rollers 238 are adapted to feed the picture segments to the suction drum 218 intermittently, one after another, maintaining a space having a width equal to the width W of the picture segment therebetween. The suction drum 218 sucks the picture segment 4*a* to transfer and release it by its forward end first, and presses the picture segment 4*a* onto the mounting sheet 8A. As a result, the picture segment 4*a* is glued to the mounting sheet 8A.

At the same time, the picture segment 6*a* cut by the cutter 242 is fed by feed rollers 239 to the suction drum 219. The feed rollers 239 are also adapted to feed intermittently the picture segments to the suction drum 219 one another after while maintaining the space of width W therebetween. The suction drum 219 transfers and presses the picture segment 6a onto a portion of the mounting sheet 8A just before the portion where the picture segment 14a is being transferred. In this way, picture segments 4a to 4d and 6a to 6d of the picture sheets 214A and 216A are glued consecutively in interleaved fashion onto the mounting sheet 8A.

At a location after the suction drum 219 on the path along which the mounting sheet 8A is transported, there is a roller 244 provided with an edge 243 disposed opposite an elastic roller 245 for forming the folding lines 107 between the picture segments on the picture display sheet 8. There is also a cutter 247 disposed between two pairs of forwarding rollers 246 and 248 for cutting off the mounting sheet 8A to a predetermined length sufficient to include the two complete pictures 4 and 6. Specifically, the picture display sheet 8 is separated by cutting the mounting sheet 8A with picture segments between the picture segment 6d of a previous display sheet and the picture segment 4a of the picture display sheet 8. In this way, the picture display sheet 8 shown in FIGS. 6 and 11 which includes the two complete pictures 4 and 6 in the form of two interleaved series of picture segments 4a to 4d and 6a to 6d and the folding lines 107 between consecutive picture segments can be produced automatically.

Figure 15:
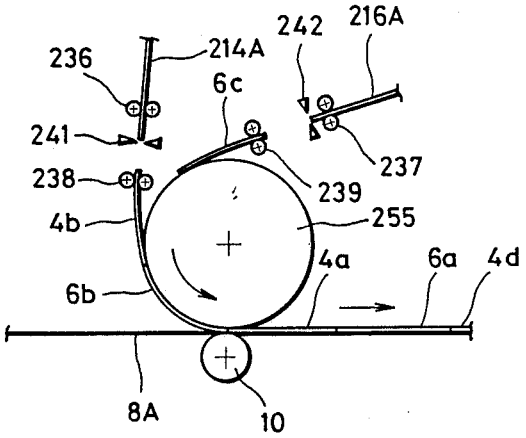
FIG. 15 is a fragmentary illustration showing a suction drum with which the suction drum of the apparatus shown in FIG. 14 may be replaced.

In the above-described apparatus, the suction drums 218 and 219 may be replaced with a single suction drum 255, as shown in FIG. 15. Around the suction drum 255 picture segments 4a, 4b, . . . and 6a, 6b, . . . are fed alternately from the reels 232 and 233 by the feed rollers 238 and 239 after having been cut by the cutters 241 and 242, respectively. It is apparent that the picture segments 4a, 4b, . . . are intermittently fed one after another maintaining a space of width W therebetween to the suction drum 255. The feed rollers 239 feed intermittently the picture segments of the picture 4.

In the apparatus of FIGS. 14 and 15, each picture sheet 214A, 216A may be replaced with a picture sheet which includes various pictures, as long as the size of pictures is constant. The original picture may take various forms such as photographic prints, printed pictures, photographic films (negative and positive) or the like. Also, the number of display sections of the wavelike display surface may be increased if desired.

Of course, various changes may be made to the form, details, arrangement and proportion of parts shown without departing from the spirit of the invention, whose scope is to be measured by the appended claims which follow immediately.

What is claimed is:

1. A picture display assembly for displaying two different pictures, said assembly comprising:

means for forming a wavelike picture display surface which has two interleaved series of display sections, each of said series being disposed in a different direction, wherein said wavelike picture display surface forming means comprises at least three concave display walls each having a set of said two interleaved series of display sections;

at least three transparent members covering a corresponding one of said three concave display walls while maintaining a small space therebetween;

two sheets containing said two different pictures, each of said sheets being divided into respective sets of picture segments which are attached to corresponding ones of one of said interleaved series of display sections; and means for supporting said wavelike picture display surface forming means.

2. A picture display assembly as defined in claim 1, wherein said picture segments are removably inserted into said small space.

3. A picture display assembly for displaying two different pictures, said assembly comprising:

means for forming a wavelike picture display surface which has two interleaved series of display sections, each of said series being disposed in a different direction, wherein said wavelike picture display surface forming means comprises at least three concave display walls each having a set of said two interleaved series of display sections, a rectangular sheet member with folding lines provided at regular intervals thereon to define a plurality of sections, said rectangular sheet member being folded in zigzag to form said two interleaved series of display sections;

two sheets containing said two different pictures, each of said sheets being divided into respective sets of picture segments which are attached to corresponding ones of one of said interleaved series of display sections; and means for supporting said wavelike picture display surface forming means, comprising a panel having side walls for retaining said folding rectangular sheet member therein.

4. A picture display assembly for displaying two different pictures, said assembly comprising:

a picture display member comprising a picture mounting sheet containing two interleaved series of display sections and two picture sheets containing said two different pictures, each of said two picture sheets being divided into respective sets of picture segments, each said set of picture segments being attached to a respective one of said two interleaved series of display sections;

said picture display member being folded in a wavelike shape such that each of said two interleaved series of display sections faces in a different direction; and supporting means for supporting said folded picture display member, said supporting means comprising a display panel having side walls formed with inwardly bent edges for holding said folded picture display member and flanged edges for retaining said picture display member folded in zigzag in said display panel.

5. A picture display assembly as defined in claim 4, wherein consecutive ones of said display sections are defined by folding lines.

6. A picture display assembly as defined in claim 4, wherein said picture display member is folded in zigzag to form an angle from 80° to 90°.

7. A picture display assembly as defined in claim 4, wherein said flanged edge is formed with said display panel.

8. A picture display assembly as defined in claim 4, wherein said flanged edge is removably attached to each end of said display panel.

9. A picture display assembly for displaying two different pictures, said assembly comprising:

a picture display member comprising a picture mounting sheet containing two interleaved series of display sections and two picture sheets containing said two different pictures, each of said two picture sheets being divided into respective sets of picture segments, each said set of picture segments being attached to a respective one of said two interleaved series of display sections;

said picture display member being folded in a wave-like shape such that each of said two interleaved series of display sections faces in a different direction; and supporting means for supporting said folded picture display member, said supporting means comprising a display panel having side walls formed with inwardly bent edges for holding said folded picture display member, end covers removably attached to both ends of said display panpel for retaining said picture display member folded in zigzag in said display panel, and a transparent cover plate attached to upper edges of said side walls.

10. A picture display assembly as defined in claim 9, wherein said end covers are transparent.

* * * * *